US010932538B2

(12) United States Patent
Wolf et al.

(10) Patent No.: US 10,932,538 B2
(45) Date of Patent: Mar. 2, 2021

(54) PORTABLE BEACH SAFE

(71) Applicant: Beachsafe LLC, Wayne, NJ (US)

(72) Inventors: Scott Joel Wolf, Wayne, NJ (US); Robin Jill Strauss, Fort Lee, NJ (US)

(73) Assignee: BEACHSAFE LLC, Wayne, NJ (US)

( * ) Notice: Subject to any disclaimer, the term of this patent is extended or adjusted under 35 U.S.C. 154(b) by 0 days.

(21) Appl. No.: 16/307,706

(22) PCT Filed: Aug. 10, 2018

(86) PCT No.: PCT/US2018/046336

§ 371 (c)(1),
(2) Date: Dec. 6, 2018

(87) PCT Pub. No.: WO2019/033045

PCT Pub. Date: Feb. 14, 2019

(65) Prior Publication Data

US 2020/0397104 A1 Dec. 24, 2020

Related U.S. Application Data

(60) Provisional application No. 62/543,541, filed on Aug. 10, 2017.

(51) Int. Cl.
*A45C 1/12* (2006.01)
*A45C 13/20* (2006.01)
(Continued)

(52) U.S. Cl.
CPC ..... *A45C 1/12* (2013.01); *A45C 13/20* (2013.01); *E05B 73/0011* (2013.01); *E05G 1/005* (2013.01); *E05B 2047/0014* (2013.01)

(58) Field of Classification Search
CPC ..... A45C 1/12; A45C 13/20; E05G 1/005; E05G 1/00; E05G 1/026; E05G 1/04;
(Continued)

(56) References Cited

U.S. PATENT DOCUMENTS 3,817,064 A * 6/1974 Sallee ..... E05B 73/0005 70/58
4,293,808 A 10/1981 Varadi et al.
(Continued)

FOREIGN PATENT DOCUMENTS

WO WO-0036947 A1 6/2000
WO WO-2015104649 A1 7/2015

*Primary Examiner* — Lloyd A Gall
(74) *Attorney, Agent, or Firm* — Mark C. Johnson; Johnson Dalal

(57) ABSTRACT

A portable safe that includes a lower shell defining an internal cavity and having a cable aperture and a cable end aperture defined on the body of the safe. The lower shell is lockably and translatably coupled to the cover and the safe includes a cable-reel assembly with a retractably extendable cable having a free end. The cable is operably configured to extend a cable length sufficient for the free end to at least partially surround the safe body and be received within the cable end aperture. The safe includes a cable locking position along a cover translation path with the cover and lower shell encapsulating the second cavity and with the free end of the cable longitudinally retained by the cover and/or the lower shell. The safe also includes an article loading position to expose the second cavity.

19 Claims, 13 Drawing Sheets

(51) Int. Cl.
*E05G 1/00* (2006.01)
*E05B 73/00* (2006.01)
*E05B 47/00* (2006.01)

(58) Field of Classification Search
CPC . E05G 1/024; E05G 2700/02; E05B 73/0011; E05B 2047/0014; E05B 73/0005
USPC ..... 70/14, 18, 30, 49, 58, 63, 159–162; 109/50–52; 248/551–553; 220/210
See application file for complete search history.

(56) References Cited

U.S. PATENT DOCUMENTS 4,454,824 A 6/1984 Wood
4,474,116 A * 10/1984 Castenada, Jr. ..... A45C 13/20 109/50
4,488,764 A * 12/1984 Pfenning ..... H01R 13/6397 439/133
4,573,332 A * 3/1986 Ma ..... A45C 13/20 109/52
4,667,491 A 5/1987 Lokken et al.
4,776,188 A * 10/1988 Dalaba ..... B62H 5/003 70/233
5,595,073 A * 1/1997 Sullivan ..... E05B 17/002 70/159
6,155,715 A * 12/2000 Lake ..... A47G 29/20 150/102
6,604,390 B1 * 8/2003 Nooner ..... B65D 55/14 109/50
6,870,089 B1 3/2005 Gray
7,409,915 B2 8/2008 Hagar
7,866,505 B2 * 1/2011 Perlman ..... A45C 13/18 220/835
8,789,884 B1 * 7/2014 Edelman ..... E05B 65/0075 297/188.13
9,410,344 B2 8/2016 Stacey et al.
9,574,390 B2 2/2017 Beckman
9,822,578 B2 * 11/2017 Peck ..... E05G 1/02
10,180,026 B2 * 1/2019 Peck ..... E05G 1/026
10,329,830 B2 * 6/2019 Peck ..... A47C 1/14
2002/0158602 A1 10/2002 McNair, Jr.
2003/0051646 A1 3/2003 Cinquegrano
2006/0060114 A1 3/2006 Walker
2009/0165682 A1 7/2009 Cleveland et al.
2010/0281930 A1 11/2010 Hacker
2012/0222589 A1 * 9/2012 Miyashita ..... E05G 1/005 109/40
2012/0298018 A1 11/2012 McCabe
2012/0318711 A1 12/2012 Stacey et al.
2014/0041558 A1 * 2/2014 Lubotta ..... E05G 1/08 109/38
2014/0060125 A1 3/2014 Yang
2014/0266001 A1 * 9/2014 Wilde ..... H02J 7/35 320/101
2014/0366784 A1 * 12/2014 Berger ..... G07C 9/00896 109/23
2017/0245612 A1 8/2017 Janzen

* cited by examiner 12-12

20-20

2500

PORTABLE BEACH SAFE

CROSS-REFERENCE TO RELATED APPLICATION

This application is a national stage filing of International Application Number PCT/US18/46336, filed Aug. 10, 2018, which claims priority to U.S. Provisional Patent Application No. 62/543,541, filed Aug. 10, 2017, the entirety of which is incorporated by reference.

FIELD OF THE INVENTION

The present invention relates generally to safes, and, more particularly, relates to portable safes operably configured for safe, efficient and effective use at a beach or other remote location.

BACKGROUND OF THE INVENTION

Safes are well known to provide security for a user's personal items, often which are monetarily or sentimentally valuable to the user and others. Generally, safes define a security enclosure where these personal items are placed, wherein access to the security enclosure is generally provided through one or more locking mechanism operably configured to lock and unlock based on a programmed and/or predefined access code. Most of these known safes are heavy and/or cumbersome, leaving them incapable or impracticable to be portable and/or used remotely.

Those known safes that are portable are not conducive for use in remote locations, as they are prone to being easily moved, thereby increasing the likelihood of theft. For example, one known storage device employs the use of a detachable tether having a loop and cable, wherein the cable is wrapped around an object the storage device is desired to be attached to, the distal end of the cable is then inserted through the loop, and the distal end is locked to the body of the storage device. When the cable is unlocked from the body, the security enclosure of the storage device is open for the user to insert and/or remove personal items or articles. This tether-to-body connection is problematic in that when the connection between the storage device and cable is jeopardized, so is the ability to effectively use the device as a safe. Moreover, the mechanism used to secure the tether to the storage device is prone to failure after repeated use.

Other known devices employ multiple chambers or structures that are specially designed and sized/shaped to be separated and combined together to secure a user's personal items. One such example can be seen depicted in U.S. Pat. No. 4,667,491, issued to Lokken et al. Problematically, however, these devices fail over time due to material expansion and contraction and/or because of impacts with the structures that prevent them from being efficiently and effectively combined with and separated from one another. Additionally, these devices take a longer time to secure the user's personal items, which many user's find undesirous.

Moreover, when used in remote locations, where electricity is scant, many users do not have the ability charge their electronic devices. Specifically, in certain scenarios at remote locations, a user desires to leave his or her personal belongings behind while he or she engages in other activities. One example includes the beach. The aforementioned safes and most known safes do not provide a means for charging a user's device effectively and efficiently while at said remote locations.

Therefore, a need exists to overcome the problems with the prior art as discussed above.

SUMMARY OF THE INVENTION

The invention provides a beach safe that overcomes the hereinafore-mentioned disadvantages of the heretofore-known devices and methods of this general type and that effectively, efficiently, and safely stores a user's personal items and/or articles while at a remote location, while simultaneously enabling the safe to electrically charge or power a user's electronic device, e.g., cellphone.

With the foregoing and other objects in view, there is provided, in accordance with the invention, a portable beach safe is disclosed that includes a portable safe body with a lower shell having a plurality of sidewalls and a bottom wall defining an internal cavity. The lower shell may include a cable aperture on one of the plurality of sidewalls disposed a first side of the safe body and a cable end aperture defined on a top terminal end of one of the plurality of sidewalls and that is disposed on a second side of the safe body. The second side of the safe body may be opposite the first side of the safe body. The safe assembly may also include a cover incorporating one or more photovoltaic cells selectively electrically couplable to a USB port defined on the safe body and hingedly and lockably coupled to the lower shell. The cover may have a top surface defining a plurality of apertures exposing the at least one photovoltaic cell to an ambient environment of the portable safe body. The safe may include a cable-reel assembly disposed within the inner cavity and have a retractably extendable cable with a free distal end, the cable disposed in the cable aperture and operably configured to extend from the cable aperture a cable length sufficient for the free end to at least partially surround the safe body and be received within the cable end aperture. The safe also includes a cable locking position along a cover translation path with the cover, plurality of sidewalls, and bottom wall encapsulating the second cavity and with the free end of the cable longitudinally retained by at least one of the cover and the lower shell. Additionally, the safe includes an article loading position along the cover translation path with a portion of the cover removed from the lower shell and exposing the inner cavity.

In accordance with a further feature of the present invention, the free end of the cable includes a flange substantially surrounding the cable, wherein the flange has an inner surface.

In accordance with another feature, an embodiment of the present invention includes the cable locking position having the free end of the cable longitudinally retained, through the inner surface of the flange, by both the cover and the lower shell.

In accordance with yet another feature, an embodiment of the present invention also includes the lower shell having a shelf member and an inner partition wall both coupled to at least two of the plurality of sidewalls that, together with the bottom wall, thereby separating the inner cavity into a first cavity and a second cavity and encapsulating the first cavity. The shelf member may define a shelf recess thereon spatially coupled to the cable end aperture and sized to receive a portion of the cable and shaped and sized to receive a portion of the flange when in the cable locking position.

In accordance with an additional feature, another embodiment of the present invention also includes the cover having an electrically conductive charging prong disposed on an inner surface of the cover, wherein the electrically conductive charging prong is aligned, when the cover is in the closed position, with an electrically conductive receiving prong disposed on an outer surface the shelf member. The electrically conductive charging prong is also electrically coupled to the at least one photovoltaic cell and the electrically conductive receiving prong is electrically coupled to a battery disposed within the first cavity and/or the at least one USB port.

In accordance with another feature, an embodiment of the present invention also includes the cover having a cover recess defined thereon that is sized to receive a portion of the cable and shaped and sized to receive a portion of the flange. The shelf and cover recesses may be each shaped to contour portions of the free end of the cable. Additionally, the shelf and cover recesses may be symmetrically shaped with respect to one another.

In accordance with yet another feature, an embodiment of the present invention also includes a manual dial-lock assembly with a dial pad coupled to the cover and exposed to the ambient environment, wherein the manual dial-lock assembly is operably configured to engage a locking pin directly coupled to the lower shell to lockably couple the cover to the lower shell when in the cable locking position.

In accordance with the present invention, a portable beach safe is also disclosed that includes a portable safe body with a lower shell having a plurality of sidewalls, a bottom wall, and an inner partition wall defining at least one USB port formed thereon and separating and coupled to at least two of the plurality of sidewalls to define a first cavity and a second cavity. The safe includes a cover rotatably coupled to the lower shell and incorporating at least one photovoltaic cell selectively electrically couplable to the at least one USB port, wherein the cover has a top surface defining a plurality of apertures exposing the at least one photovoltaic cell to an ambient environment of the portable safe body and with a closed cover position along a cover translation path with the cover locked with the lower shell to encapsulate the second cavity. The safe may define a cable aperture thereon that spatially couples the first cavity to the ambient environment of the portable safe body and may define a cable end aperture thereon and disposed inside of the safe body when the cover is the closed cover position, wherein the cable end aperture spatially couples the inside of the safe body and the ambient environment. The safe may also include a cable-reel assembly disposed within the first cavity and having a retractably extendable cable with a free distal end having a flange disposed thereon, the cable disposed in the cable aperture and operably configured to extend from the cable aperture a cable length sufficient for the free end to at least partially surround the safe body and be received within the cable end aperture. The safe may also include a shelf member coupled to at least two of the plurality of sidewalls that, together with the shelf member and the bottom wall, encapsulate the first cavity, wherein the shelf member defines a shelf recess thereon spatially coupled to the cable end aperture and sized to receive a portion of the cable. Additionally, the safe includes an electrically conductive charging prong disposed on an inner surface of the cover, wherein the electrically conductive charging prong is aligned with an electrically conductive receiving prong disposed on an outer surface the shelf member when the cover is in the closed cover position, and wherein the electrically conductive charging prong is electrically coupled to the at least one photovoltaic cell and the electrically conductive receiving prong electrically coupled to a battery disposed within the first cavity and/or the at least one USB port. The safe also includes a cable locking position along the cover translation path with the cover in the closed cover position and the flange of the free end of the cable longitudinally retained by at least one of the cover and the lower shell and an article loading position along the cover translation path with a portion of the cover removed from the lower shell and exposing the second cavity.

Although the invention is illustrated and described herein as embodied in a portable beach safe, it is, nevertheless, not intended to be limited to the details shown because various modifications and structural changes may be made therein without departing from the spirit of the invention and within the scope and range of equivalents of the claims. For example, while the present invention is entitled "beach" safe, its application shall not be so limited, as those of skill in the art will appreciate other beneficial applications and/or intended uses. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" or "longitudinally" should be understood to mean in a direction corresponding to an elongated direction of the cable.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
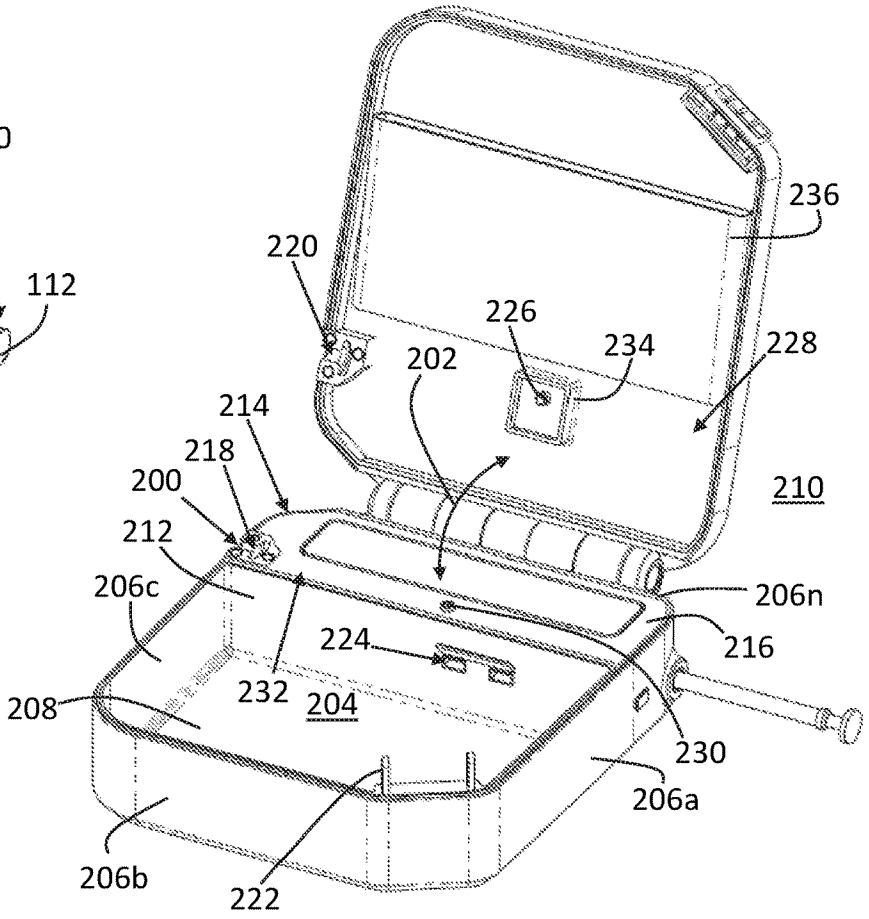
FIG. 2 is a perspective front view of the portable beach safe of FIG. 1 in an open position.
Figure 1:
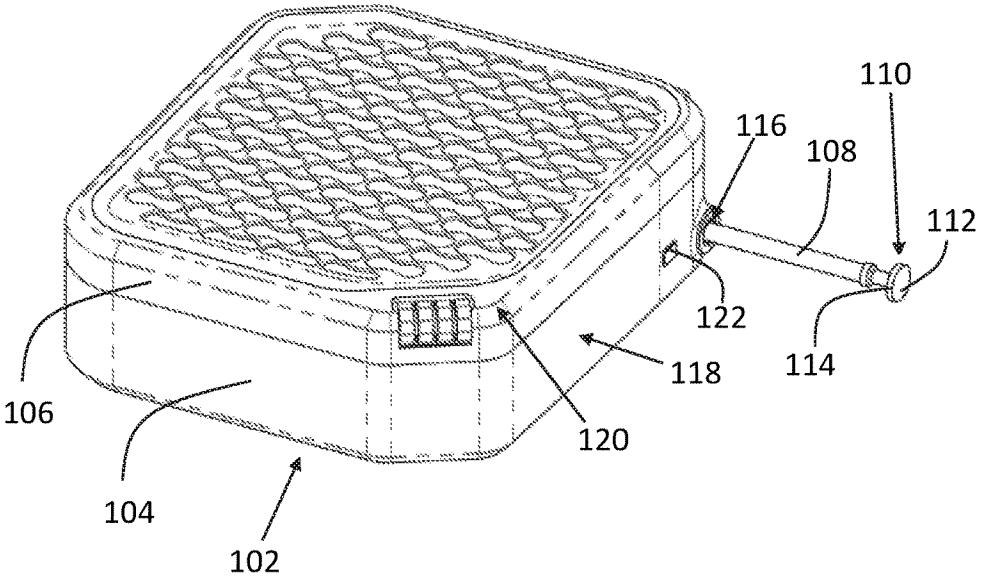
FIG. 1 is a perspective front view of a portable beach safe in a closed position in accordance with one embodiment of the present invention.
Figure 3:
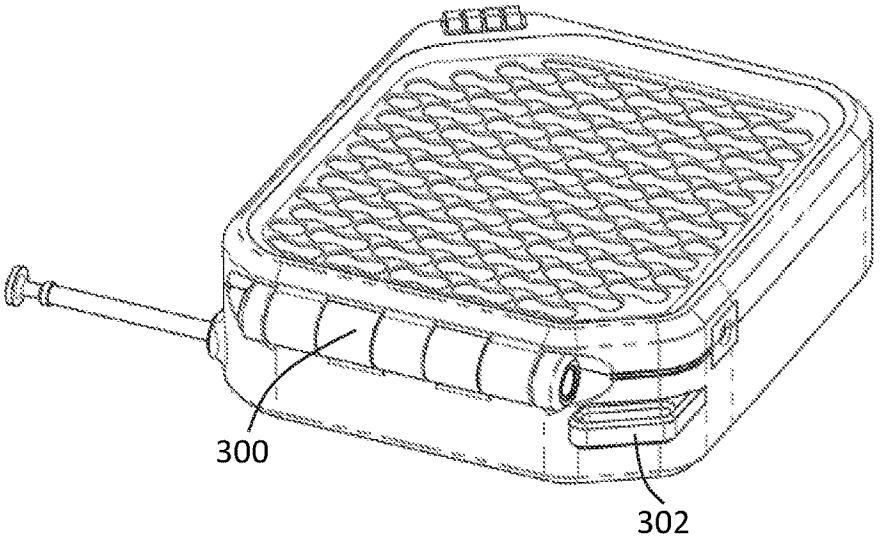
FIG. 3 is a perspective rear view of the portable beach safe of FIG. 1 in the closed position.
Figure 4:
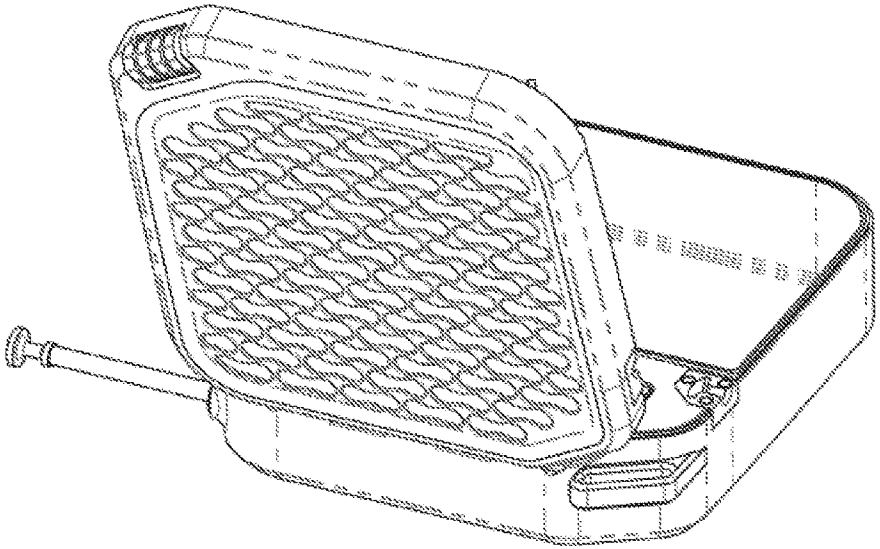
FIG. 4 is a perspective rear view of the portable beach safe of FIG. 1 in the open position.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient safe that advantageously permits users to safely store smaller articles when at remote locations, e.g., a beach, and/or while traveling away from the user's home. Embodiments of the invention provide a safe that enables its internal contents to be selectively lockable by the user and retained to a structure using an extendable and retractable cable. In addition, embodiments of the invention also provide a safe that effectively and efficiently powers a user's electronic device, e.g., cellphone, when stored within the safe.

Referring now to FIGS. 1-5, one embodiment of the present invention is shown in a perspective views and an exploded view. The figures show several advantageous features of the present invention, but, as will be described below, the invention can be provided in several shapes, sizes, combinations of features and components, and varying numbers and functions of the components. The first example of a beach safe 100, as shown in the figures, includes a portable safe body 102 with a lower shell 104 and a cover 106 translatably coupled thereto, e.g., rotatable, slidable, etc. The body 102 is portable in that it can beneficially be easily transported and/or carried by a user, and is less than approximately 15-20 lbs. To effectuate in the transportation, carrying, or coupling of the safe 100, the body 102 may include one or more handles or rigid loops, e.g., loop 302 shown best in FIG. 3, disposed thereon. To secure the safe 100 to a structure or object, e.g., a beach chair, the safe beneficially utilizes an extendable and retractable cable 108 with a free end 110 having a head 112 that includes a flange 114. The flange 114 is beneficially sized and shaped to be received within a cable end aperture 200 defined on the safe body 100 and retained from longitudinal movement when the cover 106 is in a closed position with respect to the lower shell 104. When the cover 106 is in the open or "article loading" position along the cover translation path 202 (exemplified best in FIG. 2), a portion of the cover 106 is removed from the lower shell 104 and exposes the second cavity 502 for placement of articles or personal items in the second cavity 502. The safe 100 may also include other pockets or cavities, e.g., elastic mesh pocket 236, designed to securely store personal items of a user. In one embodiment, the components of the body 102 may be of a polymeric material, e.g., ABS, PVC, etc., having a rigidity of approximately 50-150 Shore A. In other embodiments, the components of the body 102 may be of lightweight metallic or composite material.

More specifically, the cover 106 may have a cover translation path (exemplified with arrow 202 in FIG. 2) that exposes an internal cavity 204 defined by the lower shell 104 of the safe body 102. The cover translation path 202 may be circular in one embodiment. In other embodiments, the cover translation path 202 may be linear. The cover 106 may be directly or hingedly coupled to the lower shell 104 through, for example, a mechanical hinge 300 (depicted best in FIG. 3). When the cover 106 is in the closed position (exemplified best in FIGS. 1 and 3), the lower shell 104 and cover 106 encapsulate the internal cavity 204. The lower shell 104 may include a plurality of sidewalls 206*a-n*, wherein "n" represents any number great than 1, and a bottom wall 208. When in the closed position, the cover 106 and lower shell 104 may be in a watertight coupling configuration with one another using, for example, a gasket that substantially surrounds and is directly coupled to the upper surface of the sidewalls 206*a-n* and/or the cover 106. The watertight configuration inhibits or prevents the transfer of liquid, e.g., water, from the ambient environment 210 into the internal cavity 204. In other embodiments, the cover 106 and lower half 104 may not be disposed in a watertight configuration.

Figure 5:
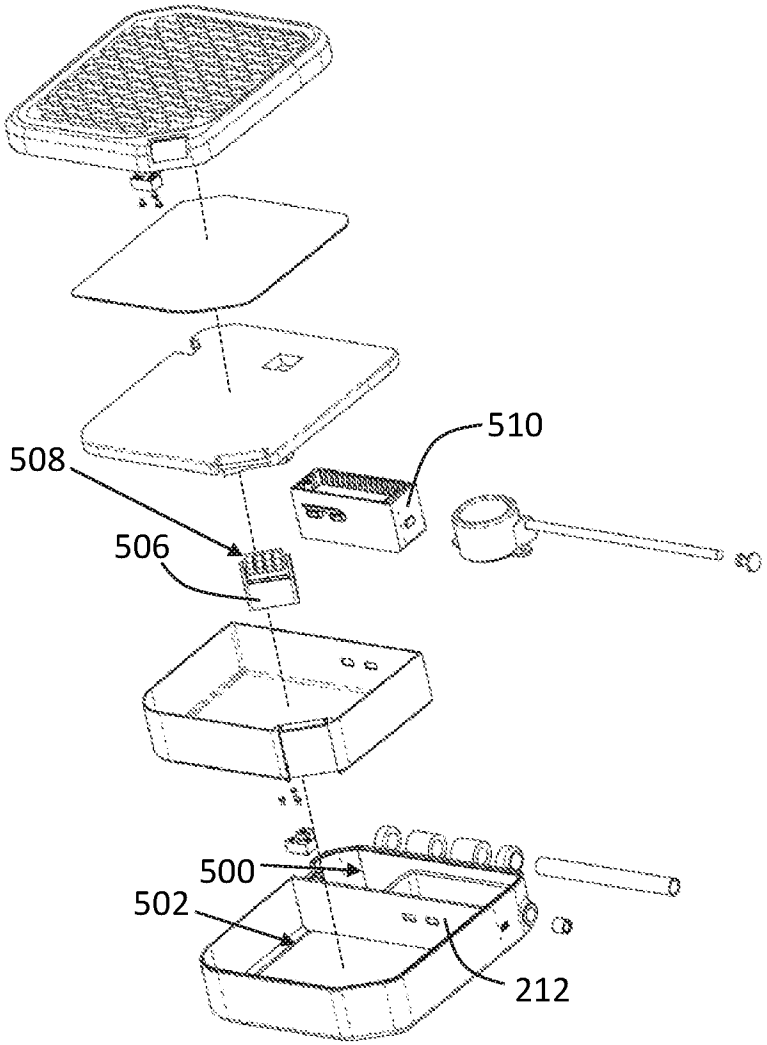
FIG. 5 is an exploded view of the portable beach safe of FIG. 1.
Figure 6:
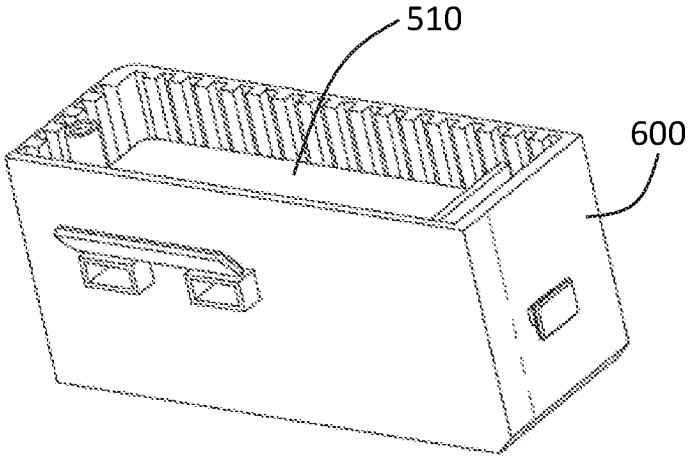
FIG. 6 is a perspective view of a battery assembly in accordance with an exemplary embodiment of the present invention.
Figure 9:
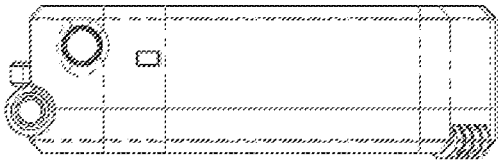
FIG. 9 is an elevational left-side view of the portable beach safe of FIG. 1.
Figure 8:
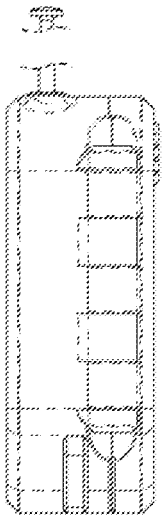
FIG. 8 is an elevational rear view of the portable beach safe of FIG. 1.
Figure 11:
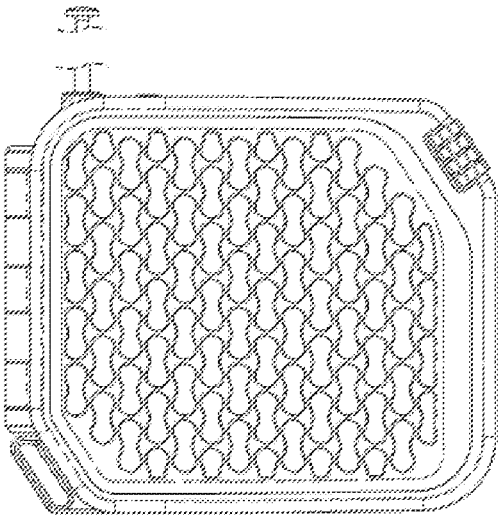
FIG. 11 is a top plan view of the portable beach safe of FIG. 1.
Figure 10:
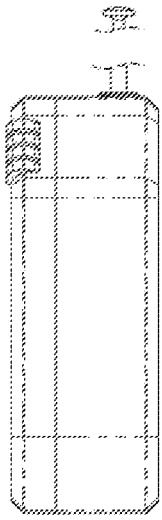
FIG. 10 is an elevational front view of the portable beach safe of FIG. 1.
Figure 7:
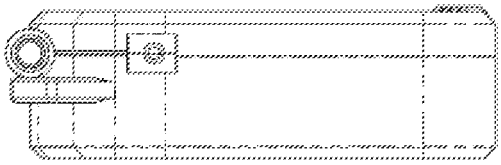
FIG. 7 is an elevational right-side view of the portable beach safe of FIG. 1.
Figure 12:
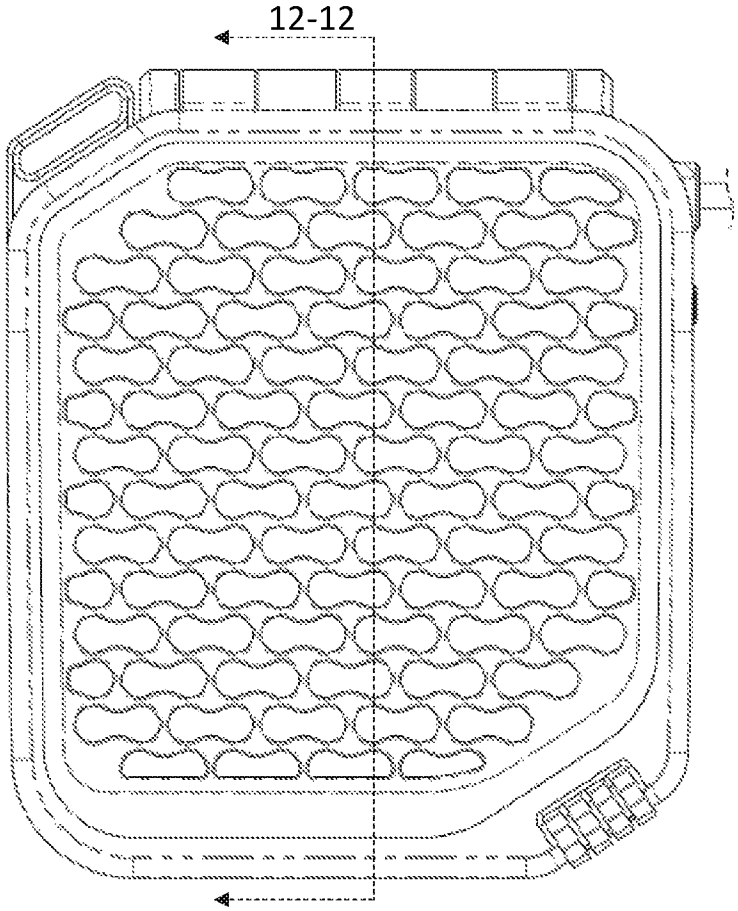
FIG. 12 is another top plan view of the portable beach safe of FIG. 1.
Figure 13:
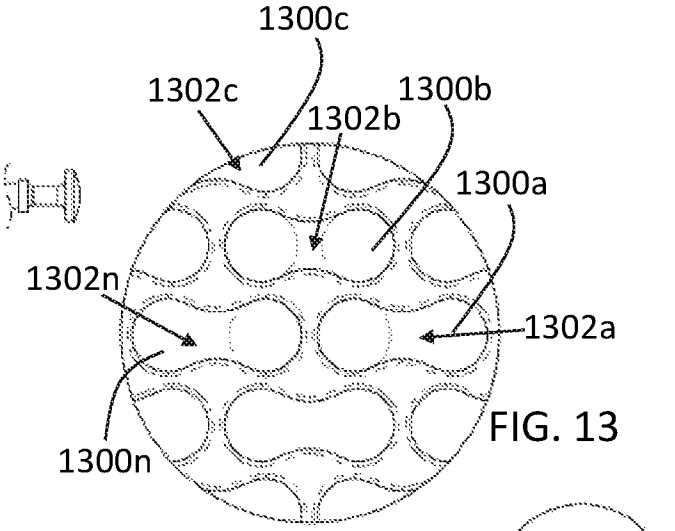
FIG. 13 is a close-up view of a plurality of photovoltaic cells and apertures in accordance with an exemplary embodiment of the present invention.

The safe body 102 also includes an inner partition wall 212 that separates the inner cavity 204 into a first cavity 500 and a second cavity 502 (as best seen depicted in FIG. 5). Beneficially, the first cavity 500 is designed and sized to house the electrical components and a cable-reel assembly that includes the cable 108 and the real assembly 2200 (shown best depicted in FIG. 22). The inner partition wall 212 is coupled to at least two of the plurality of sidewalls 206*a-n*, e.g., sidewalls 206*a*, 206*c*. The sidewalls 206*a-n* and bottom wall 208 may be substantially enclosed, i.e., preventing undesired access and/or liquid to the internal cavity 204.

With reference to FIGS. 1, 5, 18, and 22, the reel assembly 2200 is operably configured to extend and retract the cable 108 from within the first cavity 500 to the ambient environment 200. The reel assembly 2200 may also be self-retracting and employ the use of a spiraled retracting and/or compression spring(s) and/or multiple nested spring(s). In other embodiments, the reel assembly 2200 may utilize a pair of auxiliary drums mounted inside the rotating storage reel. One of the auxiliary drums rotates with the storage reel while the other drum remains stationary and fixed to the mounting bracket. A portion of the proximal end of the cable 108 is then wound in opposite directions about the two drums. As the cable 108 is withdrawn or retracted, a rotating sheave unwinds the cable 108 from one of the auxiliary drums while winding it over the other. The winding and unwinding action on the two auxiliary drums permits the proximal end of the cable 108 to remain permanently connected without twisting during storage and retraction. As such, a portion of the cable 108 is disposed in the cable aperture 116 and operably configured to extend from the cable aperture 116 a cable length 2202 sufficient for the free end 110 to at least partially surround the safe body 102 and be received within the cable end aperture 200. Other components may also be employed with the reel assembly 2200, e.g., a reel housing, a storage reel, a cable clamp or retainer, a ratchet gear, a pawl, and a coil spring.

The cable 108 may be of a metallic material, e.g., stainless steel, and continuously span from its proximal end to the free end 110. The cable 108 may include a width or diameter sized to enter and egress through a cable aperture 116 defined on one of the plurality of sidewalls, e.g., 206*a*. In one embodiment, the cable aperture 116 is disposed a first side, e.g., side 118, of the safe body 102. As such, the head 112 and end 110 of the cable 108 is operably configured to extend a sufficient cable length 2202 from the side 118 to at least partially surround the safe body 102 and be received within the cable end aperture 200. In one embodiment, the cable end aperture 200 is defined on a top terminal end 214 of one of the plurality of sidewalls, e.g., 206*c*, disposed on a second side, e.g., the side 302 (shown best depicted in FIG. 3), of the safe body 102. In other embodiments, the cable end aperture 200 does not begin at the top terminal end 214, e.g., it is disposed centrally on one of the plurality of sidewalls 206*a-c*. In one embodiment, the second side 302 of the safe body 102 is opposite the first side 118 of the safe body 102 to provide a larger and more structural stable cable diameter when the end 110 of the cable 108 is disposed within the retained within the cable end aperture 200 and retained by the lower half 104 and/or the cover 106. In one embodiment, the cable diameter length 2202 and diameter may be approximately 10-48" and approximately 3-15, respectively.

Figure 14:
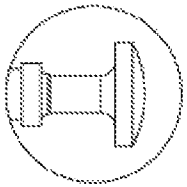
FIG. 14 is a close-up view of a free end of a cable in accordance with an exemplary embodiment of the present invention.
Figure 15:
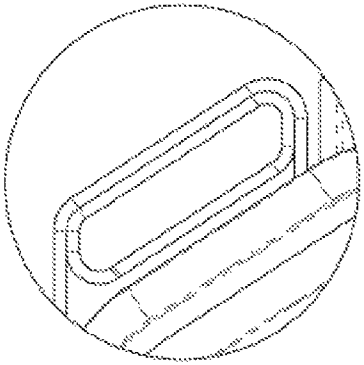
FIG. 15 is a close-up view of a safe handle or loop in accordance with an exemplary embodiment of the present invention.
Figure 17:
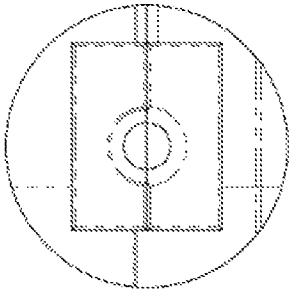
FIG. 17 is a close-up view of a cable end aperture in accordance with an exemplary embodiment of the present invention.
Figure 16:
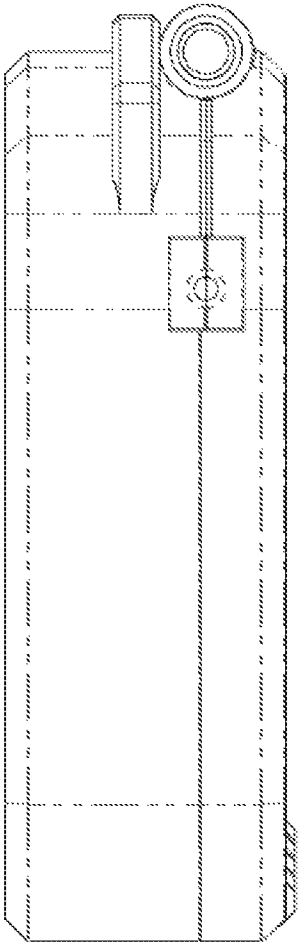
FIG. 16 is another elevational right-side view of the portable beach safe of FIG. 1.
Figure 20:
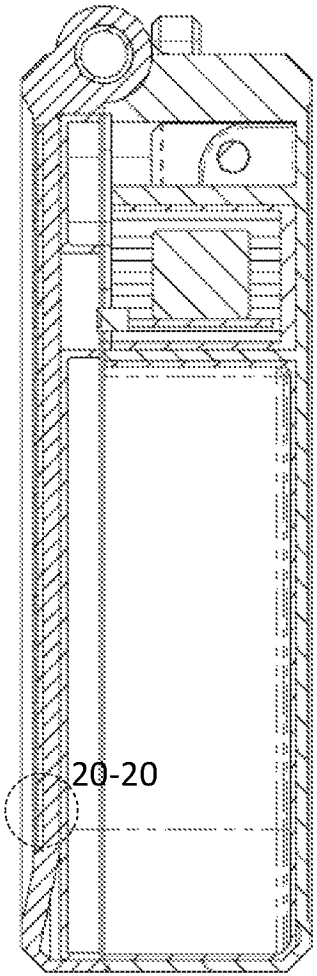
FIG. 20 is a cross-sectional view of the portable beach safe of FIG. 12 along section line 12-12.
Figure 19:
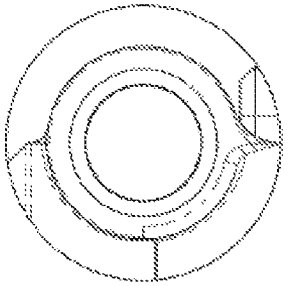
FIG. 19 is a close-up view of a hinge coupling a cover and lower shell of the safe in accordance with an exemplary embodiment of the present invention.
Figure 21:
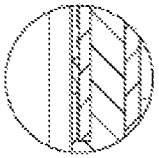
FIG. 21 is a close-up view of the cross-sectioned area 20-20 in FIG. 20.
Figure 18:
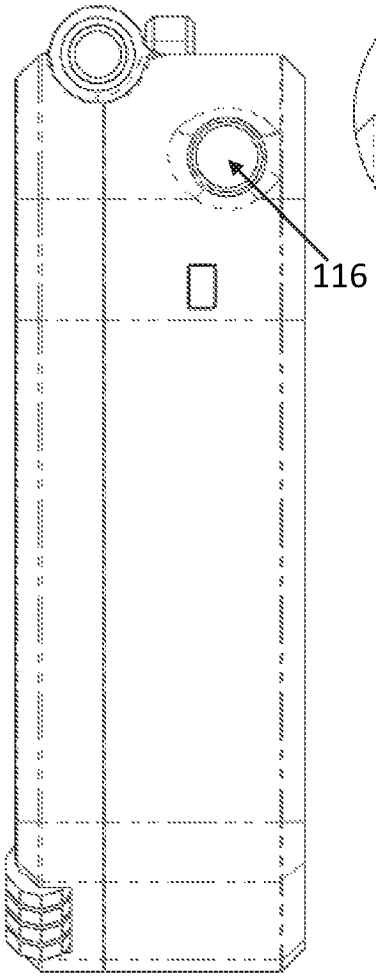
FIG. 18 is another elevational left-side view of the portable beach safe of FIG. 1.

To enable the user to quickly and effectively grasp the end 110 of the cable 108, the cable may include a secondary support flange 2204 sized to exceed the cable aperture 116. As the reel assembly 2200 may be self-retracting, the second support flange 2204 prevents the entire cable 108 from entering the first cavity 500. In other embodiments, the outer flange 114 prevents the entire cable 108 from entering the first cavity 500 or the cable 108 has a possession along a cable translation path with the cable 108 fully recessed within the first cavity 500. In one embodiment, the flanges 114, 2204 disposed at or proximal to the free distal end 110 of the cable 108 substantially surround, i.e., >50%, the circumference of the cable 108, which may have a circular, rectangular, or other shape. As best seen in FIG. 14, the flanges 114, 2204 also include inner surfaces 2206, 2208, respectively, that are adapted to restrict longitudinal movement of cable 108 during certain positions along the cable translation path when the cable 108 is extended and retracted. Said another way, the inner surface of the flange 114, along with the cover 106 and/or the lower shell 104, enables longitudinal retention of the free end 110 of the cable 108 when inserted within the cable end aperture 200 and when the cover 106 is in the closed or "cable locking position" along the cover translation path 202.

Figures 22, 23, 24:
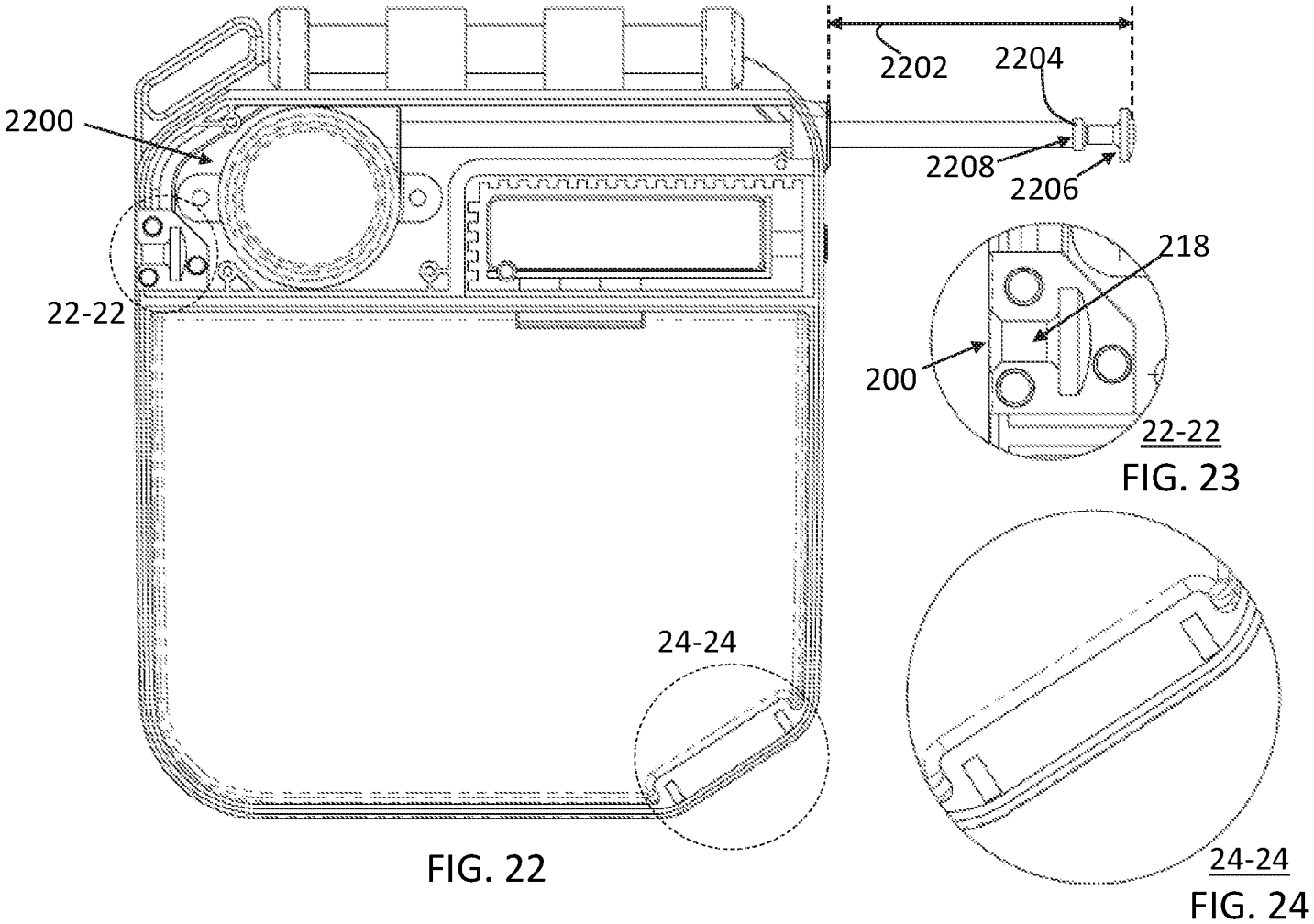
FIG. 22 is a fragmentary view of the portable beach safe of FIG. 1 with the cover removed.
FIG. 23 is a close-up view of the area 22-22 in FIG. 22.
FIG. 24 is a close-up view of the area 24-24 in FIG. 22.
Figure 26:
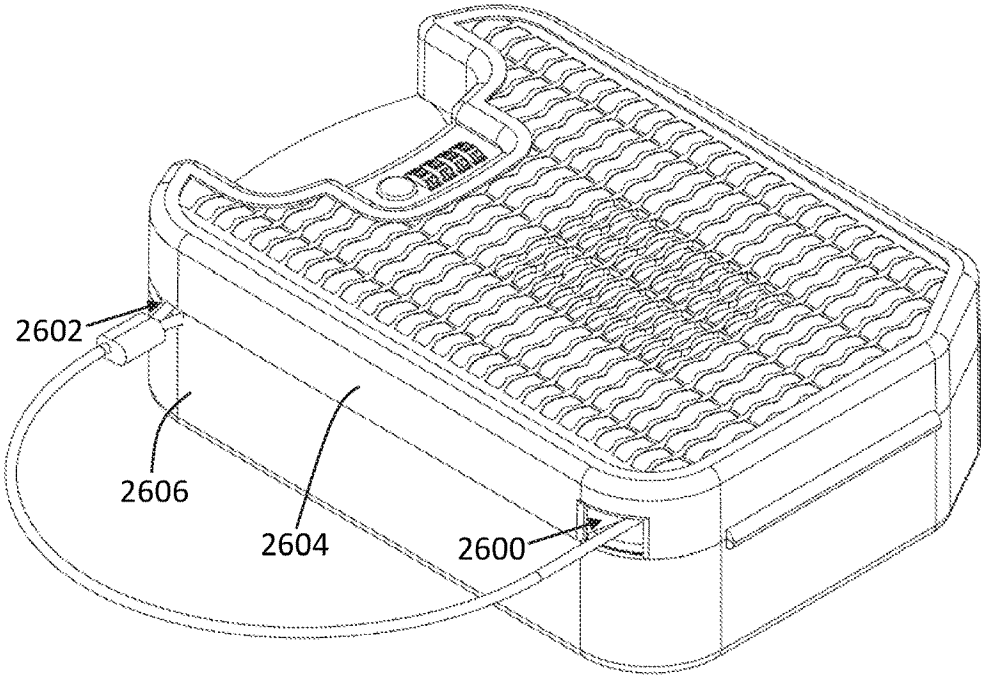
FIGS. 26-27 are perspective views of the portable beach safe of FIG. 25.
Figure 25:
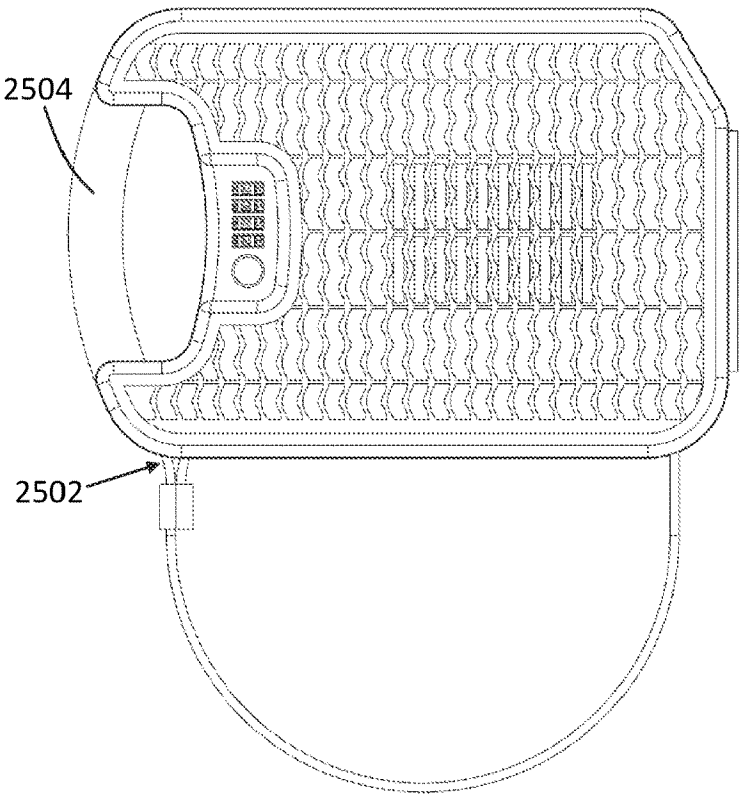
FIG. 25 is a top plan view of a portable beach safe in a closed position in accordance with another embodiment of the present invention.
Figure 28:
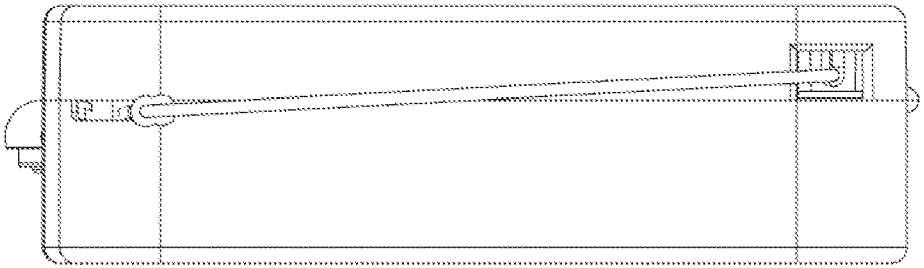
FIGS. 28-29 are elevational side views of the portable beach safe of FIG. 25 in a closed and open position, respectively.
Figure 29:
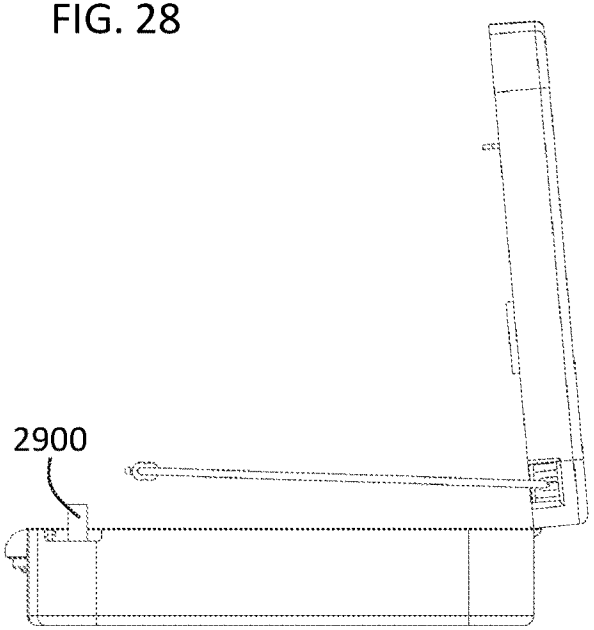
Figure 27:
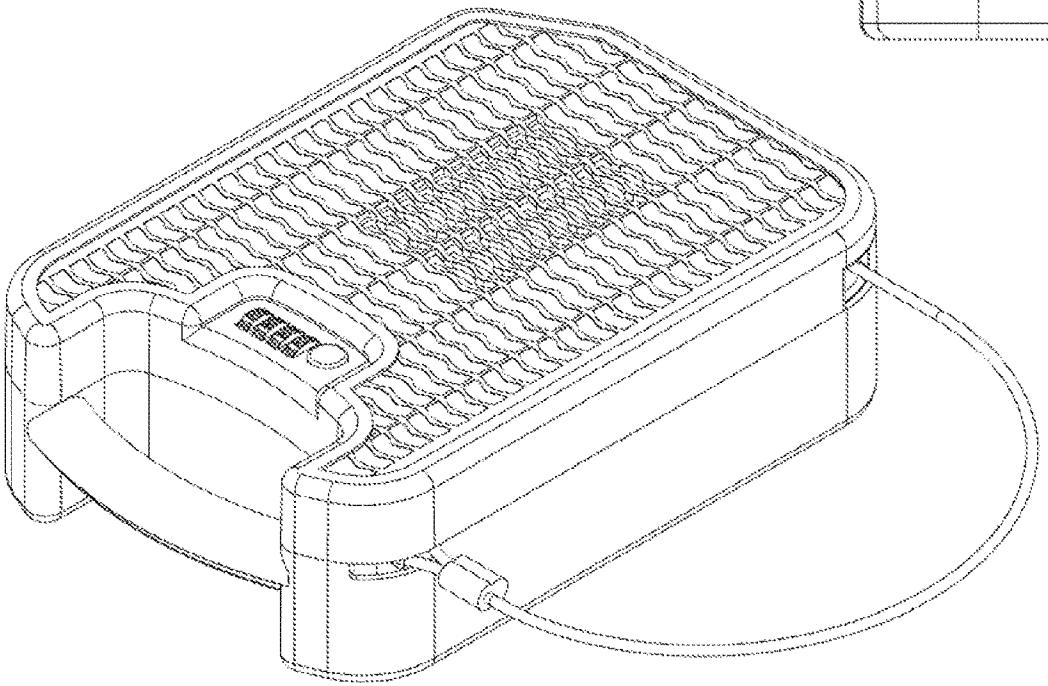
Figure 31:
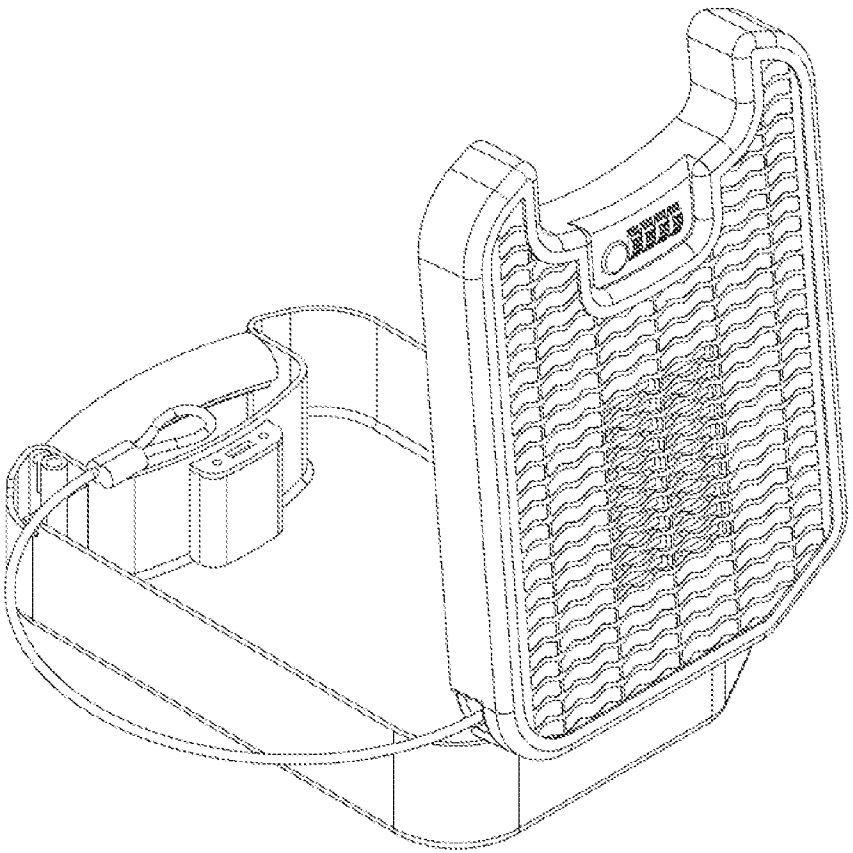
FIGS. 30-31 are perspective views of the portable beach safe of FIG. 25 in an open position.
Figure 30:
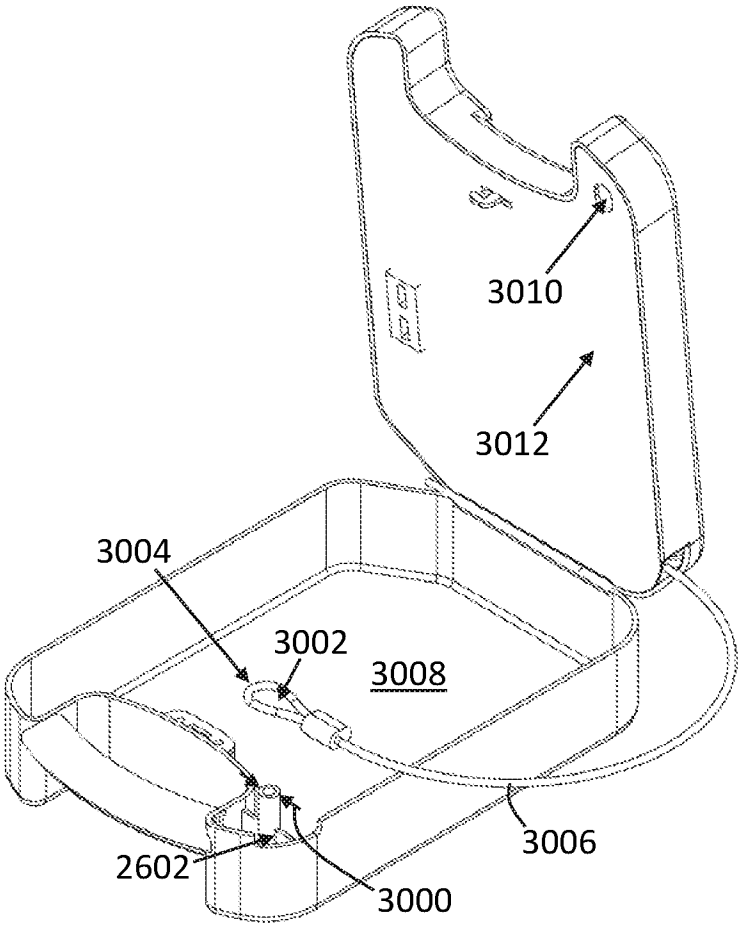

With reference now to FIGS. 1-2, 5, and 22-23, the safe body 102 also includes a shelf member 216 coupled to at least two of the plurality of sidewalls 206*a-n*, e.g., sidewalls 206*a* and 206*c*. The shelf member 216, together with the inner partition wall 212 and the bottom wall 208, encapsulate the first cavity 500. As best seen in FIG. 23, the shelf member 216, however, defines a shelf recess 218 spatially coupled to the cable end aperture 200 and is sized to receive a portion of the cable 108. The shelf recess 218 may also be shaped and sized to receive a portion of the flange 114 when in the cable locking position along the cover translation path 202. In one embodiment, the shelf recess 218 corresponds to the entire shape and size of the flange and associated head 112 of the free end 110 of the cable 108 so that the entire head 112 is fully recessed within the shelf recess 218. The shelf member 216 enables the safe body 102 to effectively retain the free end 110 of the cable 108 without disadvantageously increasing the thickness of one or more portions of the sidewalls 206*a-n* to withstand high tensile forces generated by tugging and/or pulling of the cable 108.

In other embodiments, the cover 106 defines a cover recess 220 that may also be sized to receive a portion of the cable 108 and may be shaped and sized to receive a portion of the flange 114 and/or the head 112. In one embodiment, the cover recess 220 fully or partially houses and/or receives the head 112 and/or flange 114 of the cable 108. Said another way, instead of utilizing the cable end aperture 200 and shelf recess 218, the head 112 and/or flange 114 of the cable 108 may be received within the cover recess 220 and longitudinally retained by the cover 106. In other embodiments, the shelf and cover recesses 218, 220 are each shaped to contour portions of the free end 110, head 112, and/or flange 114 of the cable 108 and/or the shelf and cover recesses 218, 220 are symmetrically shaped with respect to one another to provide equal and/or apportioned tensile loads on both the cover 106 and the lower half 104. As such, the structural configuration of the shelf member 216 and/or recesses 218, 220 effectively house the electronic components and cable-reel assembly 504, in addition to providing a structurally sound apparatus that can resist the tensile force generated from pulling or tugging of the cable 108 during an attempted theft of the safe 100 when coupled to an object or structure, such as a beach chair.

To lock and unlock the cover 106 from the lower half 104, the assembly 100 may also include a manual dial-lock assembly 506 having a dial pad 508 coupled to the cover 106 and exposed to the ambient environment 210. The manual dial-lock assembly 506 is operably configured to engage one or more locking pin(s) 222 directly coupled to the lower shell 104 to lockably couple the cover 106 to the lower shell 104 when in the cable locking position along the cover translation path 202. While the cover 106 and lower shell 104 are depicted with the manual dial-lock assembly 506 and pin(s) 222 coupled thereto, respectively, those of skill in the art will appreciate that said components may be inverted, so that the locking pin(s) 222 are coupled to the cover 106 and the dial-lock assembly 506 is coupled to the lower shell 104. The numerical portion of the dial pad 508 is exposed to a user through, for example, a top surface 120 of the cover 106. When desired for use, the user will input a predetermined and/or programmable numeral, letter, alphanumeric, and/or other indicia combination in the dial, thereby unlocking the pin from a shaft or locking arm of the dial-lock assembly 506, i.e., the locking pin(s) 222 will be in an "unlocked" position. When unlocked, the user may lift the cover 106, thereby enabling the user to remove, e.g., by lifting and/or sliding, the head 112, flange 114, and/or free end 110 of the cable 108 from the cable end aperture 200 and/or the shelf recess 218. When removing the cover 106 from the lower shell 104, the head 112, flange 114, and/or free end 110 of the cable 108 may be removed from the cover recess 220, if applicable.

With reference to FIGS. 1-2, 5-6, and 12-13, the safe 100 may incorporate one or more solar panel(s) with one or more photovoltaic cell(s) 1300*a-n* selectively electrically couplable, e.g., by lifting and closing the cover 106, to one or more USB port(s) 224 to beneficially charge one or more electronic device(s), e.g., a cellphone, housed within the second cavity 502 of the safe 100. The USB or other charging port(s) are preferably defined on the inner partition wall 212 of the lower shell 104 and face the second cavity 502. To provide sufficient sunlight to the one or more photovoltaic cell(s) 1300*a-n*, the top surface 120 of the cover 106 defines a plurality of aperture(s) 1302*a-n* exposing the photovoltaic cell(s) 1300*a-n* to the ambient environment 210 of the portable safe body 102. In one embodiment, the aperture(s) 1302*a-n* are of a shape and size that exceeds and/or corresponds to the shape and/or size of the photovoltaic cell(s) 1300*a-n*. In other embodiments, the shape and size of the aperture(s) 1302*a-n* will vary.

Those of skill in the art will appreciate that photovoltaic cells are electrical devices that convert the energy of light, whether it be artificial light or sunlight, directly into electricity by photovoltaic effect, which may be a physical and/or a chemical phenomenon. Advantageously, the photovoltaic cell(s) 1300*a-n* convert the radiant energy into electricity that can be used by electronic devices, electrical components of the safe 100, and the like. In one embodiment, the photovoltaic cell(s) 1300*a-n* are made of monocrystalline silicon. In another embodiment, the photovoltaic cell(s) 1300*a-n* may be made of polycrystalline silicon, multicrystalline silicon, or a similar type of semiconductor material. In one embodiment, the photovoltaic cell(s) 1300*a-n* may produce an efficiency rate of 12% to 20%. The "efficiency rate" is defined herein as the rate at which the solar-cell converts the solar energy into electricity. In another embodiment, the photovoltaic cell(s) 1300*a-n* may produce an efficiency rate of greater than 20%. In order to collect and transfer solar energy, as sunlight penetrates the photovoltaic cell(s) 1300*a-n*, the sunlight's photons create a negatively charged electron and a positively charged ion, i.e., a "hole." The negative electrons and positive ions drift toward opposite terminals of the photovoltaic cell(s) 1300*a-n*, creating a voltage difference in the photovoltaic cell(s) 1300*a-n*. When a load is electrically coupled to the terminals, electron current flows towards the positively charged holes and useful electrical power becomes available at the load. While the operation of a photovoltaic cell is known by those of skill in the art, in one embodiment, the photovoltaic cell(s) 1300*a-n* are operably configured to generate approximately 4-6 volts and approximately 0.5-2.5 amps. In a preferred embodiment, the photovoltaic cell(s) 1300*a-n* will generate approximately 5 Watts (5 volts at 1.0 amps), or another amount of current and voltage sufficient to charge an electronic device housed in the safe 100.

To effectuate transfer of the energy accumulated from the photovoltaic cell(s) 1300*a-n*, the cover 106 may include an electrically conductive charging prong 226 disposed on an inner or bottom surface 228 of the cover 106. The electrically conductive charging prong 226 may be aligned with an electrically conductive receiving prong 230 disposed on an outer surface 232 of the shelf member 216. The electrically conductive charging and receiving prongs 226, 230 may be of a metallic material such as, for example, copper. Those of skill in the art will appreciate that alignment of the electrically conductive charging and receiving prongs 226, 230 occurs while the cover 106 is disposed in a closed configuration with respect to the lower shell 104. The electrically conductive charging prong 226 is electrically coupled (directly or indirectly using, for example, electrical wire) to the photovoltaic cell(s) 1300*a-n* and the electrically conductive receiving prong 230 is electrically coupled (directly or indirectly) to, for example, a lithium-ion battery 510 (best shown in FIGS. 5-6) disposed within the first cavity 500 and/or to the USB port(s) 224. When electrically coupled to the battery 510, which may also include a battery enclosure 600 to inhibit contact with the cable 108, the battery 510 may store energy for use with the USB ports(s) 224 and/or the USB ports 122 disposed on an outer surface of the body 102. The battery 510 and USB ports 224, 122 may be electrically and/or communicatively coupled to one another for transfer of energy and/or data associated with a user's electronic device and/or an external power source. The inner surface 228 of the cover 106 and/or the outer surface 232 of the shelf member 216 may include a prong separator 234 that prevents damage to the prongs 226, 230 when the cover 106 is closed vigorously and/or to ensure a contacting relationship between the prongs 226, 230 when the cover 106 is in the closed position.

With reference now to FIGS. 25-33, another embodiment of a portable beach safe assembly 2500 is shown in various views, configurations, and positions. While this assembly 2500 has many of the same features, characteristics, positions, and components as the beach safe assembly 100 described above, it does, however, have some differences.

More specifically, the cable aperture 2600 and cable end aperture 2602 are defined on the same side of the safe body 2502. The cable end aperture 2602 may also be defined by the cover 2604, instead of the lower shell 2606. Additionally, it can be seen that the lower shell 2606 beneficially includes and defines a handle 2504 for quick and effective grasping and maneuverability of the safe 100.

The safe 2500 also beneficially includes a cantilever cable retention post 2900 coupled to the lower shell 2606. In other embodiments, the cantilever cable retention post 2900 may be coupled to the cover 2604. The cantilever cable retention post 2900 defines a post diameter 3000 that is sized to be received within a loop 3002. Said another way, the free distal end 3004 of the cable 3006 defines the loop 3002 which is shaped and sized to receive the post diameter 300 of the cable retention post 2900. The configuration and sizing of the loop 3002 and cable retention post 2900 facilitates in longitudinally retaining the free distal end 3004 of the cable 3006 when in the cable locking position (shown best in FIGS. 27-28) along the cover translation path. To maximize the capacity of the internal cavity 3008, the cable retention post 2900 may be disposed proximal to the cable end aperture 2602, e.g., within approximately 1-2 inches of the cable end aperture 2602. The cable retention post 2900 may be cylindrical to prevent increased pressure generation on the cable 3006, or may have another rounded or convex surface to support the cable 3006.

To further facilitate in providing a structure to resist the longitudinal retention of the cable 3006, the cover 2604 (or lower shell 2606, if the cover includes the post 2900) defines a cable retention post aperture 3010 defined thereon, more particularly on the bottom surface 3012 of the cover 2604. The cable retention post aperture 3010 may be shaped and sized to receive the cantilever cable retention post 2900, or the diameter 3000 of the post 2900. In one embodiment, the post aperture 3010 is slightly larger, i.e., within approximately 1-5%, than the post diameter 3000 to provide a snug fit between the post 2900 and the cover 2604. As such, the portion cover 2604 defining the cable retention post aperture 3010 is operably configured to retain the cable retention post 2900 when in the cable locking position along the cover translation path.

Figure 33:
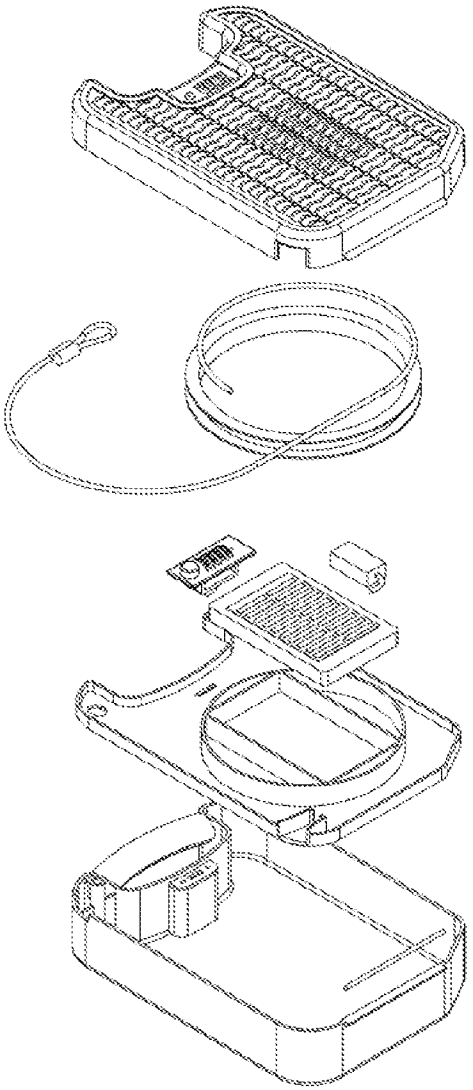
FIGS. 32-33 are exploded views of the portable beach safe of FIG. 25.
Figure 32:
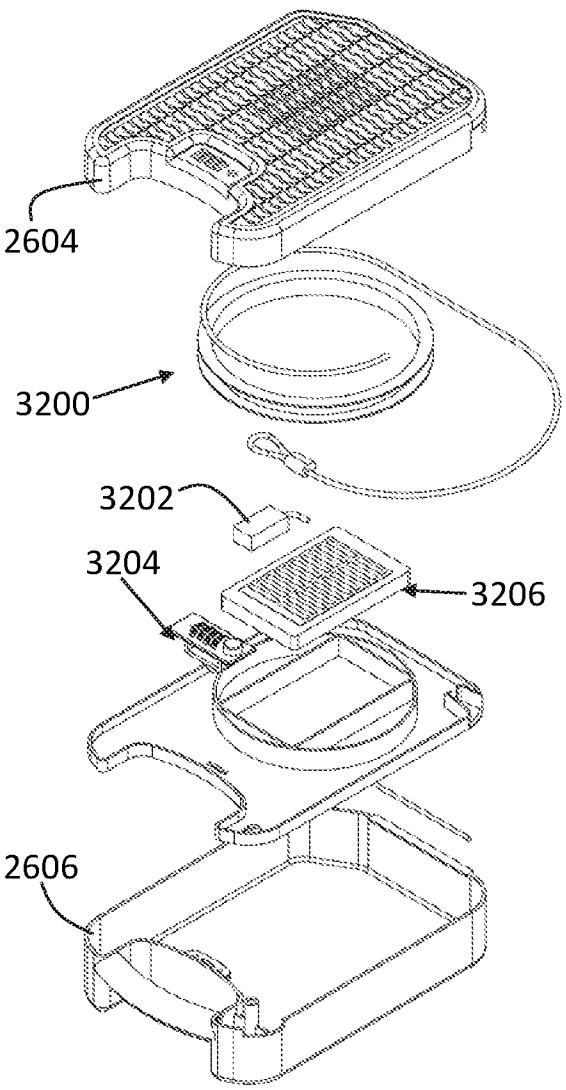

With reference to FIGS. 32-33, two exploded views can be seen of the safe assembly 2500. In said embodiment, various components and features, e.g., the retractable cable/reel assembly 3200, a USB drive assembly 3202, the locking/tumbler assembly 3204, the solar charger and battery assembly 3206, etc., can be seen and those of skill in the art will appreciate the placement and position in relation to the cover 2604 and shell 2606 to provide a safe, secure, and efficiently/effectively configured safe assembly 2500.

A portable safe has been disclosed that enables users to safely store smaller articles and charge electronic devices when the user is located at remote locations, e.g., a beach, and/or while traveling away from the user's home, work, etc. The safe also enables its internal contents to be selectively lockable by the user and retained to a structure using a specially designed cable that is extendable and retractable with respect to the safe. Although a specific order of executing process steps of opening and/or closing the cover and operating certain features of the safe has been disclosed, the order of executing the steps may be changed relative to the order described in certain embodiments. Also, two or more steps described as occurring in succession may be executed concurrently or with partial concurrence in some embodiments. Certain steps may also have been omitted for the sake of brevity. In some embodiments, some or all of the process steps can be combined into a single process completed by the user.

What is claimed is:

1. A portable beach safe comprising:

a portable safe body with:

a lower shell having a plurality of sidewalls and a bottom wall partially defining an internal cavity, the lower shell including a cable end aperture defined on a top terminal end of one of the plurality of sidewalls;

a cover incorporating at least one photovoltaic cell selectively electrically couplable to a USB port defined on the safe body and hingedly and lockably coupled to the lower shell, the cover with a top surface defining a plurality of apertures exposing the at least one photovoltaic cell to an ambient environment of the portable safe body; and a cable aperture defined on at least one of the lower shell and the cover;

a cable-reel assembly disposed within the internal cavity and having a retractably extendable cable with a free distal end, the cable disposed in the cable aperture and operably configured to extend from the cable aperture a cable length sufficient for the free end to at least partially surround the safe body and be received within the cable end aperture;

a cable locking position along a cover translation path with the cover, plurality of sidewalls, and bottom wall encapsulating the internal cavity and with the free end of the cable longitudinally retained by at least one of the cover and the lower shell; and an article loading position along the cover translation path with a portion of the cover removed from the lower shell and exposing the internal cavity.

2. The portable beach safe according to claim 1, wherein:

the cable aperture is defined on one of the plurality of sidewalls disposed on a first side of the safe body, the cable end aperture is disposed on a second side of the safe body opposing the first side of the safe body, and the free end of the cable includes a flange substantially surrounding the cable, the flange having an inner surface.

3. The portable beach safe according to claim 2, wherein the cable locking position further comprises:

the free end of the cable longitudinally retained, through the inner surface of the flange, by both the cover and the lower shell.

4. The portable beach safe according to claim 3, wherein the lower shell further comprises:

a shelf member and an inner partition wall both coupled to at least two of the plurality of sidewalls that, together with the bottom wall, separate the inner cavity into a first cavity and a second cavity and encapsulate the first cavity, the shelf member defining a shelf recess thereon spatially coupled to the cable end aperture and sized to receive a portion of the cable and shaped and sized to receive a portion of the flange when in the cable locking position.

5. The portable beach safe according to claim 4, wherein the cover further comprises:

an electrically conductive charging prong disposed on an inner surface of the cover, the electrically conductive charging prong aligned, when in the cable locking position, with an electrically conductive receiving prong disposed on an outer surface the shelf member, the electrically conductive charging prong electrically coupled to the at least one photovoltaic cell and the electrically conductive receiving prong electrically coupled to at least one of a battery disposed within the first cavity and the USB port.

6. The portable beach safe according to claim 4, wherein the cover further comprises:

a cover recess defined thereon that is sized to receive a portion of the cable and shaped and sized to receive a portion of the flange.

7. The portable beach safe according to claim 6, wherein:

the shelf and cover recesses are each shaped to contour portions of the free end of the cable.

8. The beach safe according to claim 6, wherein:

the shelf and cover recesses are symmetrically shaped with respect to one another.

9. The portable beach safe according to claim 1, further comprising:

a manual dial-lock assembly with a dial pad coupled to the cover and exposed to the ambient environment, the manual dial-lock assembly operably configured to engage a locking pin directly coupled to the lower shell to lockably couple the cover to the lower shell when in the cable locking position.

10. The portable beach safe according to claim 1, further comprising:

a cantilever cable retention post coupled to the lower shell, defining a post diameter, and disposed proximal to the cable end aperture, wherein the free distal end defines a loop shaped and sized to receive the post diameter of the cable retention post and the cable retention post longitudinally retains the free distal end when in the cable locking position along the cover translation path.

11. The portable beach safe according to claim 10, wherein the cover further comprises:

a cable retention post aperture defined thereon, the cable retention post aperture shaped and sized to receive the cantilever cable retention post, wherein the portion of the cover defining the cable retention post aperture is operably configured to retain the cable retention post when in the cable locking position along the cover translation path.

12. A portable beach safe comprising:

a portable safe body:

with a lower shell having a plurality of sidewalls, a bottom wall, and an inner partition wall defining at least one USB port formed thereon and separating and coupled to at least two of the plurality of sidewalls to define a first cavity and a second cavity;

with a cover rotatably coupled to the lower shell and incorporating at least one photovoltaic cell selectively electrically couplable to the at least one USB port, the cover with a top surface defining a plurality of apertures exposing the at least one photovoltaic cell to an ambient environment of the portable safe body and with a closed cover position along a cover translation path with the cover locked with the lower shell to encapsulate the second cavity;

defining a cable aperture thereon that spatially couples the first cavity to the ambient environment of the portable safe body; and defining a cable end aperture thereon and disposed inside of the safe body when the cover is the closed cover position, the cable end aperture spatially coupling the inside of the safe body and the ambient environment;

a cable-reel assembly disposed within the first cavity and having a retractably extendable cable with a free distal end having a flange disposed thereon, the cable disposed in the cable aperture and operably configured to extend from the cable aperture a cable length sufficient for the free end to at least partially surround the safe body and be received within the cable end aperture;

a shelf member coupled to at least two of the plurality of sidewalls that, together with the shelf member and the bottom wall, encapsulate the first cavity, the shelf member defining a shelf recess thereon spatially coupled to the cable end aperture and sized to receive a portion of the cable;

an electrically conductive charging prong disposed on an inner surface of the cover, the electrically conductive charging prong aligned with an electrically conductive receiving prong disposed on an outer surface the shelf member when the cover is in the closed cover position, the electrically conductive charging prong electrically coupled to the at least one photovoltaic cell and the electrically conductive receiving prong electrically coupled to at least one of a battery disposed within the first cavity and the at least one USB port;

a cable locking position along the cover translation path with the cover in the closed cover position and the flange of the free end of the cable longitudinally retained by at least one of the cover and the lower shell; and an article loading position along the cover translation path with a portion of the cover removed from the lower shell and exposing the second cavity.

13. The beach safe according to claim 12, wherein:

the cable end aperture is shaped and sized to receive a portion of the flange when in the cable locking position.

14. The beach safe according to claim 13, wherein the cable aperture is defined on one of the plurality of sidewalls disposed a first side of the safe body and the cable end aperture defined on a top terminal end of one of the plurality of sidewalls disposed on a second side of the safe body, the second side of the safe body opposite the first side of the safe body.

15. The beach safe according to claim 12, wherein the cable locking position further comprises:

the free end of the cable longitudinally retained, through an inner surface of the flange, by both the cover and the lower shell.

16. The beach safe according to claim 12, wherein the cover further comprises:

a cover recess defined thereon that is sized to receive a portion of the cable and shaped and sized to receive a portion of the flange.

17. The beach safe according to claim 16, wherein:

the shelf and cover recesses are each shaped to contour portions of the free end of the cable.

18. The beach safe according to claim 16, wherein:

the shelf and cover recesses are symmetrically shaped with respect to one another.

19. The beach safe according to claim 12, further comprising:

a manual dial-lock assembly with a dial pad coupled to the cover and exposed to the ambient environment, the manual dial-lock assembly operably configured to engage a locking pin directly coupled to the lower shell to lockably couple the cover to the lower shell when in the cable locking position.

* * * * *